US009095201B2

(12) United States Patent
Simonsen

(10) Patent No.: US 9,095,201 B2
(45) Date of Patent: Aug. 4, 2015

(54) EXPANDABLE INSULATED BOXED WINE CARRIER

(71) Applicant: Pamela Simonsen, Yankton, SD (US)

(72) Inventor: Pamela Simonsen, Yankton, SD (US)

( * ) Notice: Subject to any disclaimer, the term of this patent is extended or adjusted under 35 U.S.C. 154(b) by 142 days.

(21) Appl. No.: 13/764,006

(22) Filed: Feb. 11, 2013

(65) Prior Publication Data

US 2013/0206800 A1 Aug. 15, 2013

Related U.S. Application Data

(60) Provisional application No. 61/597,528, filed on Feb. 10, 2012.

(51) Int. Cl.

| | |
|---|---|
| ***B65D 81/38*** | (2006.01) |
| ***B65D 35/56*** | (2006.01) |
| ***A45F 5/00*** | (2006.01) |
| ***A45C 7/00*** | (2006.01) |
| *A45F 3/02* | (2006.01) |

(52) U.S. Cl.
CPC ..... *A45F 5/00* (2013.01); *A45C 7/0022* (2013.01); *A45C 2200/20* (2013.01); *A45F 3/02* (2013.01)

(58) Field of Classification Search
CPC ..... A45C 11/20; B67D 3/0009
USPC ..... 224/148.3; 222/105
See application file for complete search history.

(56) References Cited

U.S. PATENT DOCUMENTS

| | | | | |
|---|---|---|---|---|
| 4,334,601 | A * | 6/1982 | Davis | 224/148.3 |
| D282,138 | S * | 1/1986 | Gullikson | D7/300 |
| D286,229 | S * | 10/1986 | Knoepke et al. | D3/286 |
| 4,830,154 | A * | 5/1989 | Gerch et al. | 190/103 |
| 5,582,343 | A * | 12/1996 | Dalvey | 229/101 |
| 5,974,826 | A * | 11/1999 | Baldwin et al. | 62/457.2 |
| 6,062,434 | A * | 5/2000 | Melk | 222/175 |
| 6,334,329 | B1 * | 1/2002 | Weller | 62/371 |
| 6,478,463 | B2 * | 11/2002 | Snider | 383/18 |
| 6,536,637 | B1 * | 3/2003 | McLaughlin | 224/148.3 |
| 6,945,399 | B1 * | 9/2005 | Ong | 206/425 |
| D531,458 | S | 11/2006 | Lown | |
| 7,137,533 | B1 * | 11/2006 | Heath | 222/166 |
| D547,545 | S | 7/2007 | Boehm | |
| 7,461,761 | B2 * | 12/2008 | Hildreth | 222/181.2 |
| 7,837,076 | B2 * | 11/2010 | Welker et al. | 224/576 |
| 8,651,365 | B2 * | 2/2014 | Lymn et al. | 229/117.3 |
| 8,763,889 | B2 * | 7/2014 | Weissbrod | 229/117.13 |
| 8,955,736 | B2 * | 2/2015 | Spivey et al. | 229/117.12 |
| 2007/0245765 | A1 | 10/2007 | Casher | |
| 2010/0155437 | A1 * | 6/2010 | Broadbent et al. | 224/148.1 |
| 2010/0199711 | A1 * | 8/2010 | Smith | 62/457.4 |

* cited by examiner

*Primary Examiner* — Brian D Nash
*Assistant Examiner* — Derek Battisti
(74) *Attorney, Agent, or Firm* — Daniel Boudwin; Global Intellectual Property Agency LLC

(57) ABSTRACT

Disclosed is an expandable carrier for transporting and chilling bulk beverage containers, such as wine boxes of varying size. The device comprises an insulated housing having a hollow interior and an opening with a cover that aligns with the spout on the wine box, a securable opening that provides access to the housing interior, and an accordion-like section that can expand and contract based on the size of the wine box contained therein. A user can place a wine box in the housing, and adjust the accordion-like section as needed to create a secure fit. The user can then transport the carrier with the included shoulder strap, which enables the device to be quickly and easily moved from one location to another.

8 Claims, 2 Drawing Sheets

EXPANDABLE INSULATED BOXED WINE CARRIER

CROSS REFERENCE TO RELATED APPLICATION

This application claims the benefit of U.S. Provisional Application No. 61/597,528, filed on Feb. 10, 2012 entitled "Thermal Container for Wine Box." The above identified patent application is herein incorporated by reference in its entirety to provide continuity of disclosure.

BACKGROUND OF THE INVENTION

1. Field of the Invention

The present invention relates to a carrier for a bulk beverage container. More particularly, it pertains to an expandable carrier for transporting and chilling bulk beverage containers, such as wine boxes of varying size.

Boxed wine is becoming popular in many places, particularly due to its eco-friendliness, value and portability, and taste. Boxed wine, as can be appreciated, is contained within a plastic bag, ranging from three to five liters in size, which is filled with wine. The bag is placed within a cardboard box, which provides a protective shell for the bag. A plastic tap, which is formed within the bag, provides access to the wine, which is accessed through a hole in the box. As a user pours wine through the tap, the escaping wine acts as a vacuum, and draws air out and shrinks the size of the plastic bag. This process creates no headroom for air to fill the bag, which allows the wine contained therein to last for weeks.

Boxed wine has many advantages over wine that is distributed in a conventional wine bottle. Because air is prevented from entering into the bag, boxed wines last between four and six weeks, which is considerably longer than bottled wine. Most bottles, once uncorked, should be finished within one to two days. In addition, boxed wine does not have to be aged, but instead should be consumed when purchased. This prevents the need to purchase and store wine for years before it is ready for use. Another advantage of boxed wine is the durability afforded by its packaging. Because boxed wine is constructed from cardboard and plastic, it will not break if dropped like glass bottles often do. Finally, boxed wine is better for the environment. Cardboard boxes are lighter to ship than glass bottles, and contain a higher ratio of liquid to packaging, thereby creating a smaller carbon footprint.

Boxed wine also provides a convenient means of transporting wine to a variety of locations, such as parties and outdoor events. As can be appreciated, people enjoy sharing wine at outdoor locations or at a friend's house. Boxed wine, due to the volume of wine contained therein, is ideal for large gatherings. The difficulties encountered with boxed wine relate to transporting the wine and keeping it in a chilled state. Some people will place the box in a cooler full of ice. This can become problematic over time due to the ice melting, which can soak through the box and damage the cardboard. Some users place the box in a carrier that is designed for use with boxed wine. These devices, however, typically come in standard sizes and cannot adjust for boxes of varying size. This requires a user to select either three liter or five liter wine boxes, which limits the available wines that can be carried therein. The present invention overcomes the problems inherent in conventional wine box carriers with a device that can transport wine boxes of varying size. The device comprises an insulated carrier that accepts a bulk beverage container, such as a wine box. The bottom of the carrier includes an aperture for accessing the spout on the wine box. The device further includes an accordion-like front section that can expand and contract to accommodate wine boxes of varying size, and also includes a removable shoulder strap that allows the carrier to be transported.

2. Description of the Prior Art

Devices have been disclosed in the prior art that relate to wine boxes. These include devices that have been patented and published in patent application publications. These devices generally relate to boxed wine carriers. The following is a list of devices deemed most relevant to the present disclosure, which are herein described for the purposes of highlighting and differentiating the unique aspects of the present invention, and further highlighting the drawbacks existing in the prior art.

Specifically, Broadbent, U.S. Provisional Patent Publication No. 2010/0155437 discloses a carrier for a bulk beverage container having a spout. The device comprises a shell having walls forming a hollow interior space sized and shaped for receiving the bulk beverage container therein, an opening formed in one of the walls for passage of the spout therethrough, and a flap secured to the shell for selectively covering the opening. The flap hinges between a closed position wherein the flap covers the opening, and an open position wherein the flap does not cover the opening. The Broadbent device, while discloses a carrier that can be used for boxed wine, does not provide a means of carrying boxes of varying size. The present invention includes an accordion-like front section that can expand and contract to accommodate wine boxes of varying size. This allows a user to carry both three liter and five liter wine boxes with the same carrier.

In addition to Broadbent, Weller, U.S. Pat. No. 6,334,329 discloses a wine box cooling device for cooling and keeping cool a wine box. The wine box cooling device includes a housing that has a base portion and cover portion. The cover portion has a size adapted to cover the base portion. An ice block is positioned within the base portion and a wine box is positioned on the ice block such that a pour spout of the wine box extends over the depression. The Weller device is designed primarily for cooling a wine box with a block of ice, and is not adapted for transporting boxed wine containers of varying size. As the ice block melts, the melted water can spill as a user attempts to move the device. The present invention can transport boxed wine carriers of varying size from one location to another without the use of an ice block for cooling.

Finally, Casher, U.S. Provisional Patent Publication No. 2007/0245765 discloses a carrier that can keep three to five liter box wines of other pouched beverages cooled and readily dispensable from the bar/countertop for up to thirty days, This system serves one to three or more units of different wine or pouch containers as easy as tap beer. The refrigerated bottom plate chills the wine from the bottom up in a first embodiment, or from the bottom and side in a second embodiment. The Casher device is adapted for holding multiple boxed wine carriers, making it difficult to transport from one location to another. In addition, the device does not expand and contract to securely hold boxed wine carriers of varying size.

The devices disclosed in the prior art provide boxed wine carriers for holding and chilling boxed wines. The primary function of these devices is to surround the wine box and keep the wine contained therein chilled for consumption. These prior art devices, however, do not provide a means of expanding and contracting to fit wine boxes of varying size. The present invention discloses an accordion-like front section that can expand and contract to accommodate wine boxes of varying size with the same carrier. A user can place a wine box therein, and adjust the device as needed, which creates a secure fit. The user can then transport the carrier with the included shoulder strap, which enables the device to be quickly and easily moved from a first location to a second location.

In light of the prior art and the disclosed elements of the present invention, it is submitted that the present invention substantially diverges in design elements from the prior art. Consequently, it is clear that the present invention is not described by the art and that a need exists for an expandable boxed wine carrier for transporting and chilling wine boxes of varying size. In this regard, the instant invention substantially fulfills these needs.

SUMMARY OF THE INVENTION

In view of the foregoing disadvantages inherent in the known types of boxed wine carriers now present in the prior art, the present invention provides a new boxed wine carrier wherein the same can be utilized for providing convenience for the user when transporting and chilling wine boxes of varying size.

It is therefore an object of the present invention to provide a new and improved boxed wine carrier device that has all of the advantages of the prior art and none of the disadvantages.

It is another object of the present invention to provide a new and improved boxed wine carrier that can accept and transport wine boxes of varying size.

Another object of the present invention is to provide a new and improved boxed wine carrier that includes an insulating material that keeps the wine contained therein chilled.

Yet another object of the present invention is to provide a new and improved boxed wine carrier that includes an accordion-like front section that can expand and contract to accommodate wine boxes of varying size.

Another object of the present invention is to provide a new and improved boxed wine carrier that includes a shoulder strap allowing the carrier to be transported.

A final object of the present invention is to provide a new and improved boxed wine carrier that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
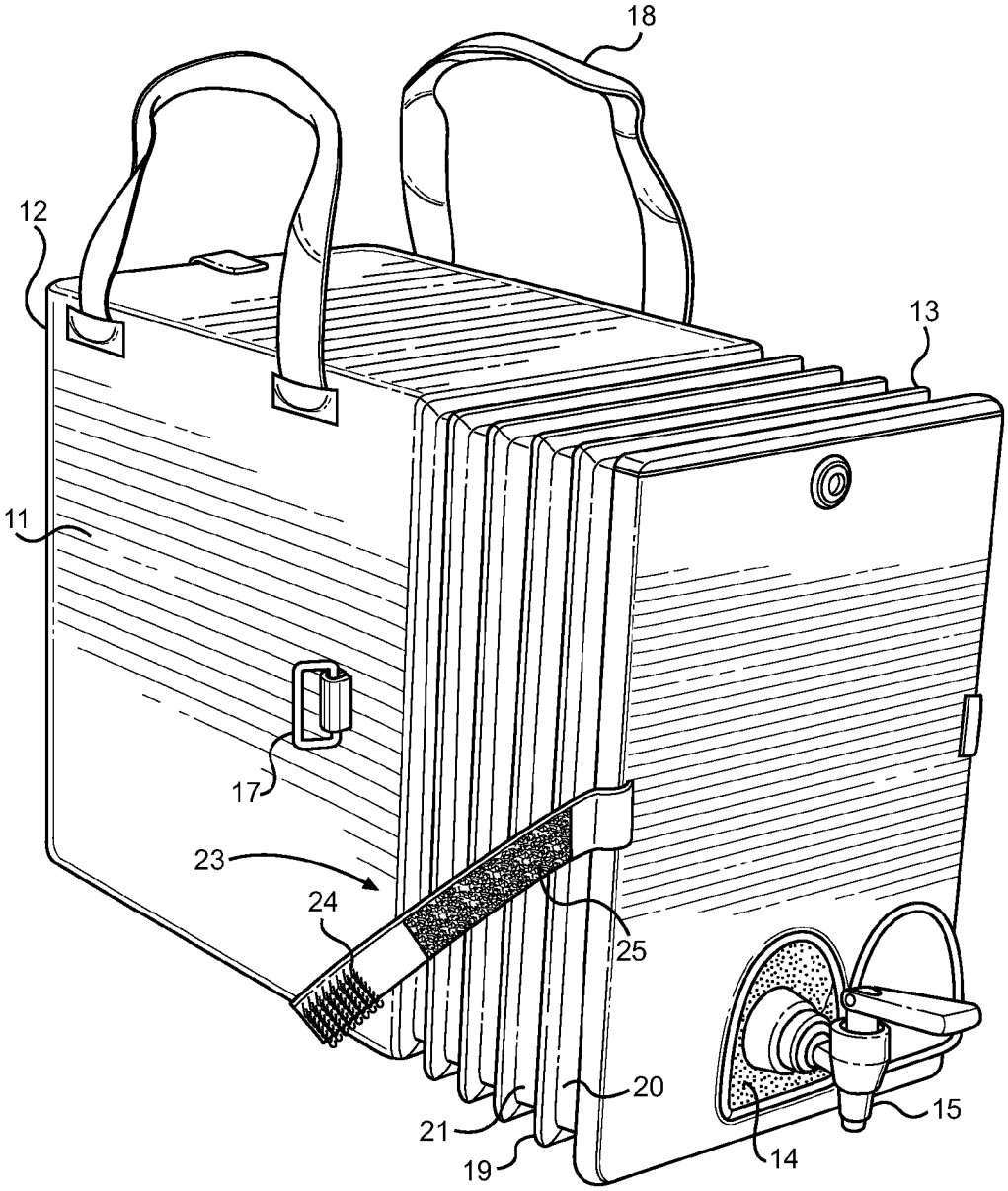
FIG. 1 is a perspective view of the present invention, with the accordion-like front section in a partially expand configuration.

Reference is made herein to the attached drawings. Like reference numerals are used throughout the drawings to depict like or similar elements of the wine box carrier. For the purposes of presenting a brief and clear description of the present invention, the preferred embodiment will be discussed as used for accepting and transporting wine boxes of varying size. The figures are intended for representative purposes only and should not be considered to be limiting in any respect.

Referring now to FIG. 1, there is shown a perspective view of the present invention, with the accordion-like front section in a partially expand configuration. The device comprises a housing 11 having a hollow interior, a securable opening 12 that allows access to the interior of the housing 11, and an expanding section 13 that resembles an accordion, that can expand and contract based on the size of the bulk beverage carrier contained therein. The expanding section 13 can be adjusted to closely fit wine boxes of varying size with a fastening means 16. Along the forward face of the expanding section 13 is an aperture 14 adapted to accept the spout 15 of a wine box bladder, which fits therethrough when the box is positioned within the housing interior. The top of the housing 11 includes a pair of carrying handles 18 that can be used to transport the carrier. An optional shoulder strap (not shown) can attach to the expanding section 13 and the rear section of the housing 11.

The wine box carrier of the present invention includes a housing 11 having walls that form a rectangular shaped hollow interior that is sized and shaped for receiving a bulk beverage container. The walls of the housing 11 can be sized and/or shaped for receiving any other suitable type of bulk beverage container. The housing 11 is preferably sized to fit the largest commercially available wine boxes therein. The housing 11 is preferably constructed of a fabric with a thermally insulating layer, such as polystyrene foam or another suitable material. The insulating layer assists with keeping the contents of the bulk beverage container thermally regulated, and prevents cooling or heating loss. This enables transport and use of a chilled wine box on a hot day without the wine contained therein from rapidly warming.

The expanding section 13 includes an accordion-like arranged structure containing a system of adjoining horizontally running bellows 19, each of which is created from two opposite pleated surfaces 20, 21. The bellows 19 are substantially symmetrical and of an arched shape, while the opposite surfaces 20, 21 are convex. The bellows 19 are stiffer than the opposite surfaces 20, 21, thereby causing the opposite surfaces 20, 21 to collapse around each bellow 19. This provides the accordion-like expanding and contracting of the expanding section 13, which enables the device to be adjusted to closely fit wine boxes of varying size contained therein.

The expanding section 13 can further include a fastening means for adjusting the device to closely fit wine boxes of varying size. In the preferred embodiment, the fastening means 16 comprises a pair of D-rings 17 attached to the housing 11, and a pair of straps 23 that can be placed through the D-rings 17 and adjustably secured in position. The strap 23 preferably includes a section of hook 24 and a section of loop 25 fastening material, which can be secured in an infinite range of tightness or looseness based on the size of the wine box contained within the housing 11. As an example, a user can place a three-liter box of wine within the housing 11, and place the strap 23 through the D-ring 17, and tighten the hook 24 and loop 25 until the housing 11 and expanding section 13 closely fit the box. A user can then remove the three-liter box and replace it with a five-liter wine box. As can be appreciated, the five-liter box requires substantially more room within the housing 11. The user can detach the hook 24 and loop 25 and expand the expanding section 13 until the five-liter box fits. The strap 23 can then be tightened, and the hook 24 and loop 25 can be reattached.

Figure 2:
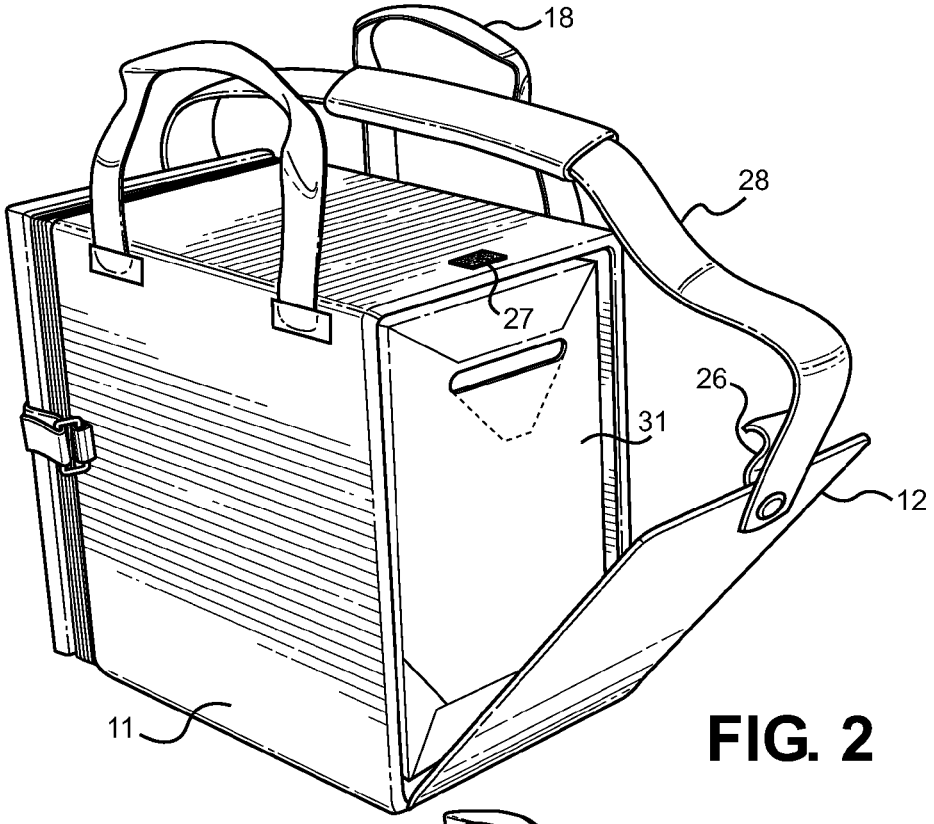
FIG. 2 is a perspective rear view of the present invention, wherein a wine box is contained within the interior compartment, and the securable opening is in a partially open configuration.

Referring now to FIG. 2, there is shown a perspective rear view of the present invention, wherein a wine box is contained within the housing, and the securable opening is in a partially open configuration. The securable opening 12 is positioned on the rear of the housing 11, and comprises a rectangular wall that is attached on one side to the housing 11. This allows the securable opening 12 to be opened and closed for installing and removing a bulk beverage container 31. The securable opening 12 includes a fastener, such as a hook-containing strap 26 on the upper section thereof, which mates with a section of loop material 27 of the top of the housing. A variety of fasteners, such as buttons, snaps, zippers, magnets, or any other suitable fastening means contemplated can be utilized to secure the securable opening 12. To install a wine box 31, a user can unfasten the fastener, and allow the securable opening 12 to open completely and lie flat on a surface. A wine box 31 can then be slidably positioned within the housing 11, the securable opening 12 can be closed, and the strap 23 can be secured through the D-ring 17.

The present invention additionally includes a variety of means for transporting the carrier from one location to another. A pair of carrying straps 18 is disposed on the top of the housing. The straps 18 are constructed of flexible nylon webbing or another suitable material, and are of sufficient length to allow for both straps 18 to be held with one hand. This enables a user to carry the device in a manner similar to a brief case. When not in use, the straps 18 can lie flat against the sides of the housing 18. Additionally, the present invention can be transported from one location to another with a shoulder strap 28. The shoulder strap 28 comprises a conventional strap that can be adjusted for length. The strap 28 removably attaches to the front of the housing 11 and to the securable opening 12 with a fastener, such as a snap or button. The front of the housing 11 and securable opening 12 provide secure anchoring points for the strap 28, and prevent the securable opening 12 from inadvertently being opened during transport. The strap 28 is of sufficient length to allow access to the interior of the housing 11 without requiring removal thereof.

Figure 3:
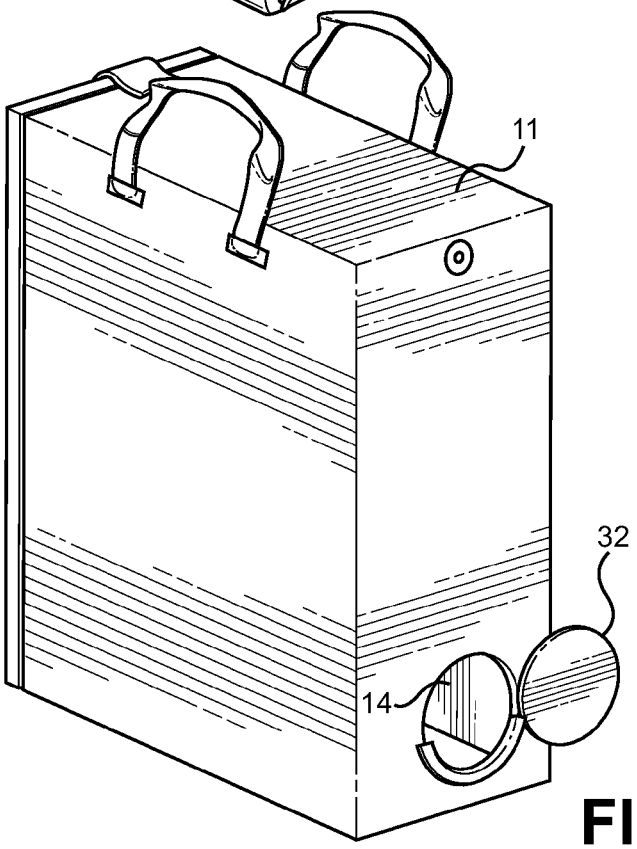
FIG. 3 is an embodiment of the present invention, wherein the device is constructed without an accordion-like front section for fitting wine boxes of a specified dimension.

Referring now to FIG. 3, there is shown an embodiment of the present invention, wherein the housing is constructed to accept bulk beverage containers of a specified size. Further shown in this figure is an embodiment that contemplates a housing 11 having a static size, wherein the device is designed for transporting and chilling beverage containers of a specified size. As can be appreciated, conventional wine boxes are constructed in four basic sizes. In this embodiment, the present invention is constructed in various sizes that are each intended for housing one of the basic sizes of boxed wine. The housing 11 is comprised of walls that form a rectangular shaped hollow interior, and is preferably constructed of a fabric with a thermally insulating layer, such as polystyrene foam or another suitable material. The front of the housing 11 includes an aperture 14 with an annular cover 32 that is comprised of plastic or another suitable material. The aperture 14 and annular cover 32 aligns with the spout on a conventional wine box, and further includes a means of securing the spout in position. This prevents the spout from being pushed into the interior of the housing where it may become inaccessible. The annular cover 32 can be secured in position over the aperture 14 when not in use, which prevents any wine from dripping from the spout.

Overall, the present invention provides a bulk beverage container carrier that houses, dispenses, and thermally regulates the contents of the wine box contained therein. The device can be adjusted to fit bulk beverage containers of varying size, which prevents the wine box contained therein from shifting about, thereby rendering the spout inaccessible. The device can be carried with a pair of handles, or with a shoulder strap, which provides convenience to the user when transporting the device from one location to another. Multiple configurations and designs are contemplated, falling within the scope and spirit of the present disclosure. Further, the outward appearance of the housing is one that may be tailored to meet a specific requirement, such as a formal event or one that addresses consistent use in a household environment. The ornamental features and shape of the enclosure is one that may be readily modified, including different materials, geometry and styles.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A carrier for a rectangular beverage container having a spout, comprising:

a substantially rectangular housing having housing sidewalls, a top wall, a bottom wall, a back face, and a forward face defining a hollow interior with an aperture through the forward face, said aperture sized to receive the spout of said rectangular beverage container;

a securable opening opposite of said forward face along said housing that provides access to said hollow interior;

a bellows type expanding section between said housing sidewalls and said forward face that can expand and contract based on the size of said beverage container within said hollow interior, and position said forward face relative to said housing sidewalls such that said spout of said beverage container is disposed through said aperture;

at least one strap and one complimentary strap ring that secure said forward face in a static position, said at least one strap extending across said expanding section and securing to said complimentary strap ring.

2. The device of claim 1, wherein said housing includes a pair of carrying handles disposed on said housing.

3. The device of claim 1, wherein said housing includes a thermally insulating layer.

4. The device of claim 1, wherein said securable opening comprises a rectangular wall that is attached on one side to the housing, said securable opening being movable from a closed position to an open position for installing and removing a bulk beverage container into said hollow interior.

5. The device of claim 4, wherein said securable opening includes a fastening means for securing said securable opening to said housing.

6. The device of claim 5, wherein said fastening means comprises a strap which removably mates with said housing using hook and loop fasteners.

7. The device of claim 1, wherein said housing includes a shoulder strap removably attachable to said housing and to said securable opening with a fastener.

8. The device of claim 1, wherein:

said complimentary strap ring is disposed along one or more of said housing sidewalls adjacent to said expanding section;

and said at least one strap is connected to said forward face and having a length that extends across said expanding section to secure to said complimentary strap ring.

* * * * *